US007786657B2

(12) United States Patent
Kato

(10) Patent No.: US 7,786,657 B2
(45) Date of Patent: Aug. 31, 2010

(54) SPARK PLUG FOR INTERNAL COMBUSTION ENGINE

(75) Inventor: Tomoaki Kato, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 98 days.

(21) Appl. No.: 12/323,970

(22) Filed: Nov. 26, 2008

(65) Prior Publication Data

US 2009/0140625 A1 Jun. 4, 2009

(30) Foreign Application Priority Data

Nov. 30, 2007 (JP) ..... 2007-309620

(51) Int. Cl.
*H01T 13/20* (2006.01)

(52) U.S. Cl. ..... 313/141

(58) Field of Classification Search ..... 313/11.5, 313/118–145; 445/7

See application file for complete search history.

(56) References Cited

U.S. PATENT DOCUMENTS 6,853,116 B2 2/2005 Hori
2002/0121849 A1 9/2002 Kanao et al.

FOREIGN PATENT DOCUMENTS

JP 2002-237365 A 8/2002
JP 2002-313524 A 10/2002
JP 2007-087969 A 4/2007

*Primary Examiner*—Joseph L Williams
*Assistant Examiner*—Brenitra M Lee
(74) *Attorney, Agent, or Firm*—Sughrue Mion, PLLC

(57) ABSTRACT

A spark plug including a ground electrode and a noble metal tip joined to a distal end portion of the noble metal tip. The noble metal tip is joined to the ground electrode via a molten bond in which the noble metal tip and the ground electrode are fused. A protruding length of the noble metal tip is 0.3 mm or more. Regarding the molten bond, relationships $50 \leqq S1+S2 \leqq 120$ and $\theta 1 > \theta 2$ are satisfied for a first molten angle S1°, a second molten angle S2°, a first contact angle θ1° and a second contact angle θ2° as defined herein.

3 Claims, 8 Drawing Sheets

SPARK PLUG FOR INTERNAL COMBUSTION ENGINE

BACKGROUND OF THE INVENTION

1. Field of the Invention

The present invention relates to a spark plug for an internal combustion engine.

2. Description of the Related Art

A spark plug for an internal combustion engine is attached to an internal combustion engine and used for igniting an air-fuel mixture in a combustion chamber. In general, the spark plug includes: an insulator having an axial hole; a center electrode inserted in the axial hole; a metal shell provided on an outer periphery of the insulator; and a ground electrode attached to a leading end surface of the metal shell. A spark discharge gap is defined between the ground electrode and a center electrode.

A noble metal tip containing a noble metal alloy such as platinum alloy is joined to a leading end portion of the ground electrode containing metal having heat-resistant and corrosion-resistant properties; such as a nickel alloy. The noble metal tip can improve spark wear resistance and ignitability. A technique for joining the noble metal tip to the ground electrode has been proposed, in which welding along an outer surface of a boundary between the ground electrode and the noble metal tip is carried out by means of a laser beam (for example, see JP-A-2002-313524 and JP-B-3460087).

Recently, an engine with a high compression ratio has been developed so as to increase engine output. In the combustion chamber of such an engine, the noble metal tip and the ground electrode are exposed to high temperatures. In addition, the heat dissipation property of the ground electrode deteriorates toward the distal end thereof, and the temperature of the ground electrode tends to become high at a portion closer to the distal end thereof. For these reasons, deformation due to a repetition of a cold-hot cycle may occur at a boundary between the noble metal tip and the ground electrode. This may cause an oxide scale, cracking, and the like at the boundary between the noble metal tip and the ground electrode, such that the noble metal tip may exfoliate from the ground electrode.

Further, the size of the spark plug has been reduced in response to a request for engine miniaturization, and the metal shell itself has become smaller in diameter and thickness. The size of the ground electrode provided at the leading end of the metal shell has to be reduced because the area joined to the metal shell is reduced. Consequently, the heat dissipation property of the ground electrode may be further lowered, and the foregoing problems may become more pronounced.

SUMMARY OF THE INVENTION

The present invention was made in consideration of the above circumstances, and an object thereof is to provide a spark plug for an internal combustion engine capable of preventing loss (falling-off) of a noble metal tip from a ground electrode due to repetition of the cold-hot cycle, and also enabling a longer life cycle.

The above objects of the invention have been achieved in accordance with the following.

In a first aspect, the present invention provides a spark plug for an internal combustion engine, comprising: a cylindrical insulator having an axial hole extending in an axial direction; a center electrode inserted in the axial hole and extending from a base end thereof to a leading end thereof in the axial direction; a cylindrical metal shell provided on an outer periphery of the insulator and extending from a leading end thereof to a base end thereof in the axial direction; a ground electrode extending from a base end thereof provided on a leading end portion of the metal shell to a distal end thereof; and a noble metal tip containing a noble metal as a main component and having a base end joined to a side surface of a distal end portion of the ground electrode and a distal end surface facing a leading end portion of the center electrode, wherein a protruding length of the noble metal tip from the side surface of the distal end portion of the ground electrode in a direction along a center axis of the noble metal tip is 0.3 mm or more, wherein the noble metal tip is joined to the ground electrode via a molten bond in which the noble metal tip and the ground electrode are fused; and, wherein relationships (i) and (ii) are satisfied for a first molten angle S1, a second molten angle S2, a first contact angle θ1 and a second contact angle θ2: (i) $50 \leqq S1+S2 \leqq 120$; and (ii) $\theta 1 > \theta 2$, where, in a cross section along a longitudinal direction of the ground electrode and containing the center axis of the noble metal tip, a first boundary point is defined as a boundary point between an outer surface of the molten bond and an outer surface of the noble metal tip; a first imaginary line is defined as a straight line that is perpendicular to the center axis of the noble metal tip and that passes through a middle point between an extension of a visible outline of the ground electrode and the first boundary point in the direction along the center axis of the noble metal tip; a first intersection point is defined as a point of intersection between the first imaginary line and a visible outline of the molten bond; a second intersection point is defined as a point of intersection between the first imaginary line and a boundary line between the molten bond and the noble metal tip; a first line is defined as a straight line passing through the first boundary point and the first intersection point; a second line is defined as a straight line passing through the first boundary point and the second intersection point; the first molten angle S1 [°] is defined as an angle between the first line and the second line; a second boundary point is defined as a boundary point between the outer surface of the molten bond and an outer surface of the ground electrode; a second imaginary line is defined as a straight line that is parallel to the center axis of the noble metal tip and that passes through a middle point between an extension of a visible outline of the noble metal tip and the second boundary point in a direction orthogonal to the center axis of the noble metal tip; a third intersection point is defined as a point of intersection between the second imaginary line and the visible outline of the molten bond; a fourth intersection point is defined as a point of intersection between the second imaginary line and a boundary line between the molten bond and the ground electrode; a third line is defined as a straight line passing through the second boundary point and the third intersection point; a fourth line is defined as a straight line passing trough the second boundary point and the fourth intersection point; the second molten angle S2 [°] is defined as an angle between the third line and the fourth line; the first contact angle θ1 [°] is defined as an angle between the first line and the extension of the visible outline of the noble metal tip; and the second contact angle θ2 [°] is defined as an angle between the third line and the extension of the visible outline of the ground electrode.

In a cross section extending along the longitudinal direction of the ground electrode and including the center axis of the noble metal tip, two molten bonds are present on opposing sides of the noble metal tip. When the molten bonds are symmetrically disposed and have a same size, S1, S2, θ1, and θ2 may be determined based on either of the molten bonds.

When the molten bonds are asymmetrically disposed or are not of the same size, S1, S2, θ1 and θ2 may be determined by: measuring the first molten angle, the second molten angle, the first contact angle and the second contact angle of each of the molten bonds; and averaging respective angles of the molten bonds.

According to the first aspect, the noble metal tip is joined to the leading end of the ground electrode, so as to enhance spark wear resistance and ignitability. In particular, since the protruding length of the noble metal from the side surface of the distal end portion of the ground electrode is 0.3 mm or greater in the direction along the center axis of the noble metal, these effects can be reliably obtained.

The base end of the noble metal tip may be joined to the ground electrode by laser welding or electron beam welding to form the molten bond. The molten bond is formed around the noble metal so as to join and fuse the noble metal tip and the ground electrode. Therefore, as compared with resistance welding, bonding strength is remarkably enhanced.

As described in the above Background of the Invention, the heat dissipation property of the ground electrode deteriorates toward the distal end thereof. Therefore, the boundary between the noble metal tip and the molten bond or the boundary between the molten bond and the ground electrode may be subject to strain stress. According to the above first aspect, the relationship of $50 \leqq S1+S2 \leqq 120$ is satisfied in connection with the molten bond, where S1(°) is the first molten angle on the noble metal tip side and S2(°) is the second molten angle on the ground electrode side. Accordingly, even when a cold-hot cycle is repeated, formation of oxidation scale in the boundary is prevented, and loss of the noble metal tip can be prevented. Consequently, the life cycle of the spark plug can be extended.

When S1+S2 is below 50(°), the volume of the molten bonds may be insufficient, and oxidation scale is easily formed due to the repetition of a cold-hot cycle. In the meantime, when S1+S2 exceeds 120(°), the molten bond is excessively large, and the molten bond may become scooped (chipped) due to corrosion.

In general, when laser welding or electron beam welding is carried out, a ground electrode containing nickel as a main component more easily fuses than does a noble metal tip. In other words, the molten bond contains larger amount of the metal component of the ground electrode in relation to that of the noble metal tip. Since the corrosion resistance of the metal component of the noble metal tip tends to be greater than that of the ground electrode, the molten bond preferably contains the metal component of the noble metal tip to the extent possible from the viewpoint of corrosion resistance of the molten bond. In this regard, according to the above first aspect, the relationship of $\theta 1 > \theta 2$ is satisfied for the first contact angle θ1 (°) on the noble metal tip side and a second contact angle θ2 (°) on the ground electrode side. Accordingly, the amount of the metal component of the noble metal tip fused in the molten bond becomes comparatively large, and the corrosion resistance can be remarkably enhanced. Consequently, loss of the noble metal tip can be reliably prevented, and the life cycle of the spark plug can be extended.

When the first contact angle θ is equal to or less than the second contact angle θ2, the amount of the metal component of the noble metal tip fused in the molten bond may be insufficient, which may deteriorate the corrosion resistance.

The following second and third aspects of the invention may be adopted so as to further enhance the effects of the spark plug of the first aspect of the invention.

In a second aspect, the present invention provides a spark plug according to the first aspect, wherein a relationship of $1.1 < \theta 1/\theta 2 \leqq 2.0$ is satisfied.

According to the second aspect, the relationship $1.1 < \theta 1/\theta 2 \leqq 2.0$ is satisfied. Hence, a sufficient amount of the metal component of the noble metal tip can be fused in the molten bond, and the corrosion resistance can be enhanced. In the meantime, when θ1/θ2 is below 1.1, the amount of noble metal tip fused in the molten bond may be insufficient. On the other hand, when θ1/θ2 exceeds 2.0, the amount of noble metal tip fused in the molten bond may be excessively large. Deformation due to the stress is then likely occur between the ground electrode and the molten bond, which may cause exfoliation at the boundary between the ground electrode and the molten bond.

In a third aspect, the present invention provides a spark plug according to the first or second aspects, wherein a relationship $20 \leqq S2 < S1 \leqq 70$ is satisfied.

According to the third aspect, the relationship of $20 \leqq S2 < S1 \leqq 70$ is satisfied. Consequently, a superior volume balance can be assured between the part of the noble metal tip in the molten bond and the part of the ground electrode in the molten bond. As a result, the noble metal tip is more stably joined to the ground electrode, and exfoliation of the noble metal tip from the ground electrode can be prevented more reliably.

DESCRIPTION OF THE EMBODIMENTS

Figure 1:
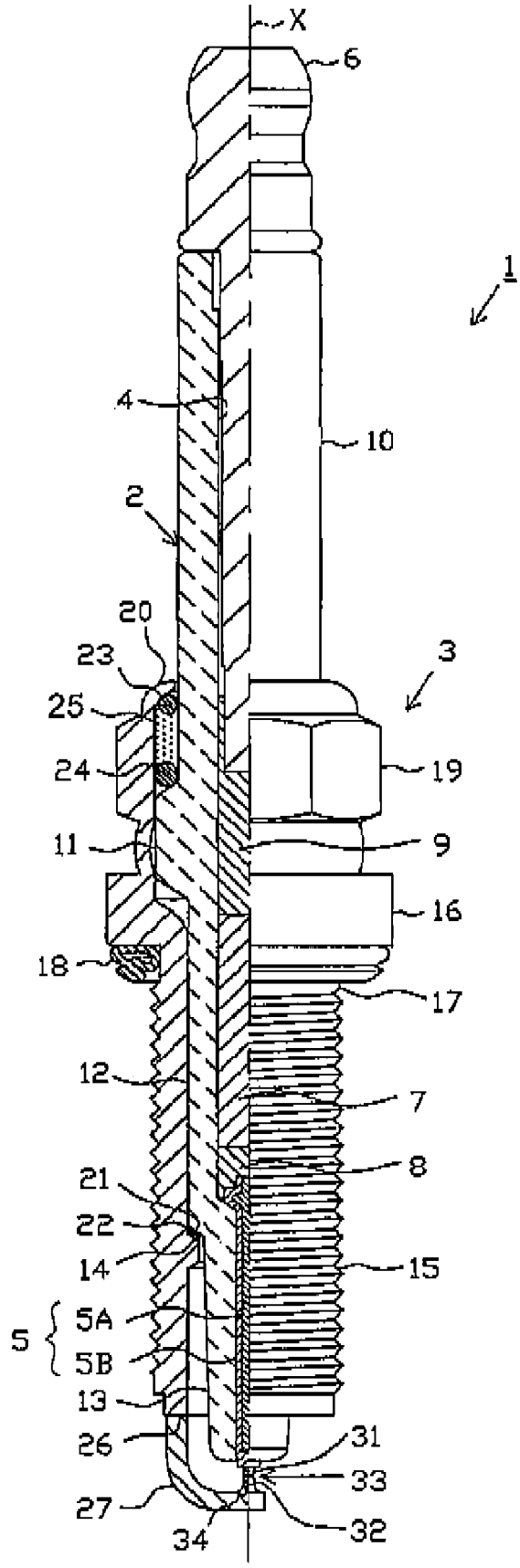
FIG. 1 is a partial sectional front view showing a spark plug of an embodiment.

An embodiment of the present invention is described with reference to the drawings. However, the present invention should not be construed as being limited thereto. FIG. 1 is a partial sectional front view showing a spark plug 1. The vertical direction in FIG. 1 corresponds to a direction of an axis X of the spark plug 1; a lower side of the axis corresponds to a leading end side; and an upper side of the axis corresponds to a base end side.

The spark plug 1 includes: a cylindrical insulator 2 and a cylindrical metal shell 3 holding the insulator 2.

An axial hole 4 penetrates the insulator 2 along the axis X. A center electrode 5 is inserted into and fixed to a leading end side of the axial hole 4, and a terminal electrode 6 is inserted into and fixed to a base end side of the same. A resistor 7 is interposed between the center electrode 5 and the terminal electrode 6 within the axial hole 4. Both ends of the resistor 7 are electrically connected to the center electrode 5 and the terminal electrode 6 via conductive glass seal layers 8 and 9.

The center electrode 5 is fixed to the insulator 2, and a part of the center electrode 5 protrudes from the leading end of the insulator 2. The terminal electrode 6 is fixed to the insulator 2, and a part of the terminal electrode 6 protrudes from the base end of the insulator 2. A noble metal tip 31 is joined to the leading end of the center electrode 5 by welding.

The insulator 2 is formed of sintered alumina, or the like. The insulator 2 includes a base end barrel portion 10 formed on the base end side; a large-diameter portion 11 located farther to the leading end side than the base end barrel portion 10 and protruding radially outward; an intermediate barrel portion 12 located farther to the leading end side than the large-diameter portion 11 and having a diameter smaller than that of the large-diameter portion 11; and a leg portion 13 located farther to the leading end side than the intermediate barrel portion 12 and having a diameter smaller than that of the intermediate barrel portion 12. A portion of the insulator 2, i.e., the large-diameter portion 11, the intermediate barrel portion 12 and a major part of the leg portion 13, is housed in the metal shell 3. A tapered step portion 14 is formed at the connection part between the leg portion 13 and the intermediate barrel portion 12, and engages the insulator 2 with the metal shell 3.

The metal shell 3 contains metal such as low-carbon steel, and has a cylindrical shape. The metal shell 3 has an outer circumferential surface provided with a threaded portion (male screw portion) 15 used for attaching the spark plug 1 to an engine head. A seat portion 16 is formed on the outer periphery on the base end side of the threaded portion 15. A ring-shaped gasket 18 is fitted to a screw neck 17 on a base end of the threaded portion 15. A tool engagement portion 19 having a hexagonal cross section used to engage a tool, such as a wrench, when the metal shell 3 is attached to the engine head, is disposed on the base end side of the metal shell 3. A crimping portion 20 for holding the insulator 2 is provided at the base end of the metal shell 3.

A tapered step portion 21 for holding the insulator 2 is provided along an inner periphery of the metal shell 3. The insulator 2 is inserted from the base end side toward the leading end side of the metal shell 3, and the step portion 14 of the insulator is held on the step portion 21 of the metal shell 3. In this state, an opening on the base end side of the metal shell 3 is crimped radially inwardly, to thereby form the crimping portion 20. As a result, the insulator is fixed to the metal shell 3. An annular plate packing 22 is interposed between the step portion 14 of the insulator 2 and the step portion 21 of the metal shell 3. Accordingly, airtightness in a combustion chamber is maintained, so that fuel air, which enters a gap between the leg portion 13 of the insulator 2 exposed to the inside of the combustion chamber and the inner periphery of the metal shell 3, can not leak to the outside.

Moreover, in order to more completely seal by crimping, annular ring members 23 and 24 are interposed between the metal shell 3 and the insulator 2 on the base end of the metal shell 3, and the space between the ring members 23, 24 is filled with talc powder 25. In other words, the metal shell 3 holds the insulator 2 by way of the plate packing 22, the ring members 23 and 24, and the talc powder 25.

Figure 2:
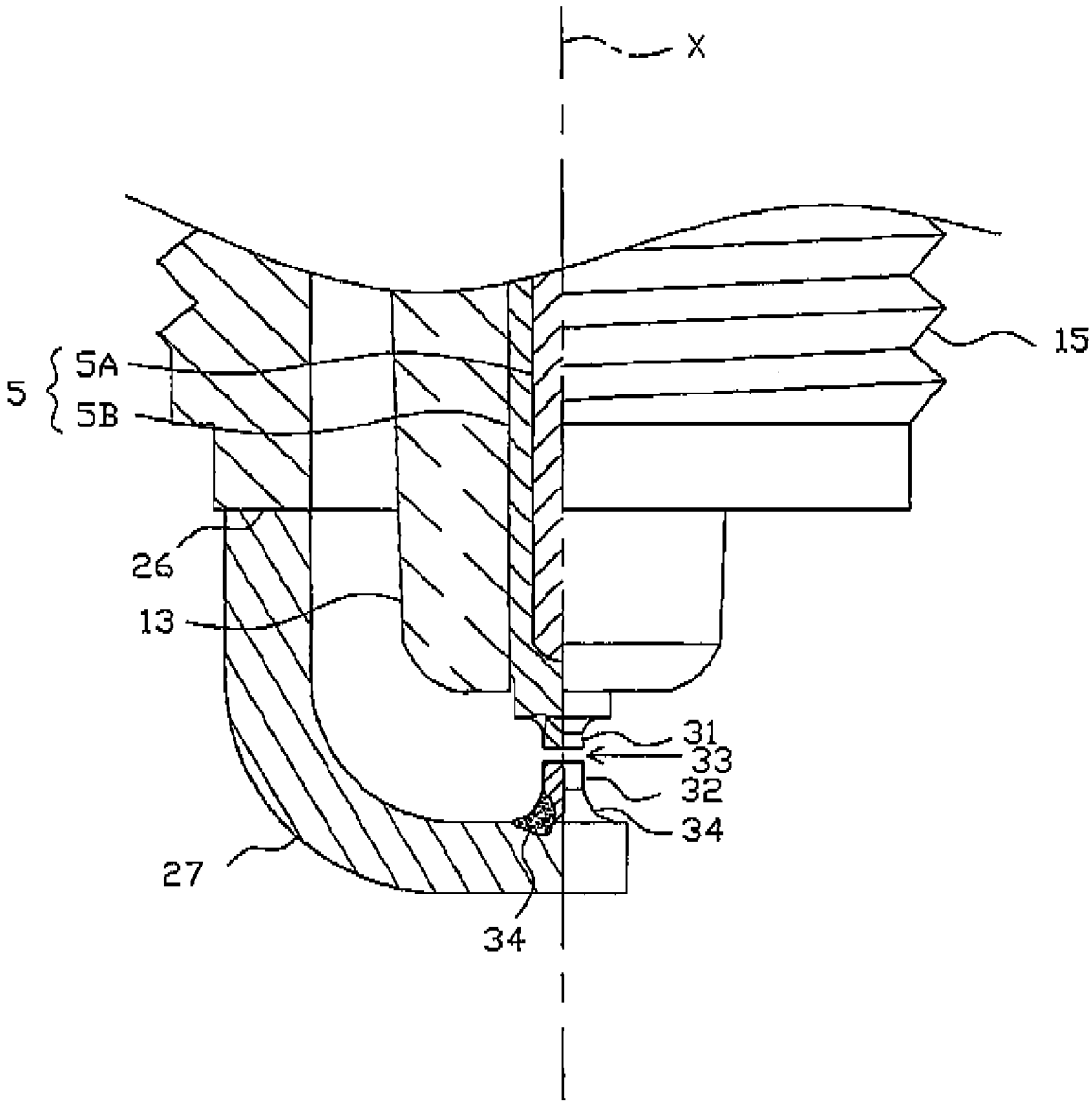
FIG. 2 is a partial sectional front view showing a leading end of the spark plug.

As shown in FIG. 2, a ground electrode 27 having a substantially L-shape in cross section is joined to a leading end surface 26 of the metal shell 3. More specifically, a base end portion of the ground electrode 27 is welded to the leading end surface 26 of the metal shell 3, and a distal end of the ground electrode 27 is bent so that a side surface of the distal end portion of the ground electrode 27 opposes the leading end portion of the center electrode 5 (the noble metal tip 31). A noble metal tip 32 is joined to the ground electrode 27 so as to oppose the noble metal tip 31. A gap defined between the noble metal tips 31 and 32 serves as a spark discharge gap 33. In the present embodiment, the noble metal tips 31 and 32 contain a noble metal material (e.g., a Pt-Ir alloy, a Pt-Rh alloy, and the like), i.e., the noble metal tips 31 and 32 contain a noble metal as a main component. As used herein, the term "main component" means contained (e.g., in the noble metal tip 31) in an amount of 50 wt % or more.

The center electrode 5 includes an inner layer 5A containing copper or a copper alloy and an outer layer 5B containing a nickel (Ni) alloy. The ground electrode 27 contains a Ni alloy.

The center electrode 5 includes a leading end portion of reduced diameter, has a rod shape (columnar shape), and a flat leading end surface. The columnar noble metal tip 31 is laid on the leading end surface of the center electrode 5, and an outer edge of an interface between the tip and the electrode is subjected to welding such as laser welding, electron beam welding or resistance welding. As a result, the noble metal tip 31 is joined to the center electrode 5.

On the other hand, the noble metal tip 32, which opposes the noble metal tip 31, is positioned on a portion of the ground electrode 27 and welded along the outer edge of an interface by means of a laser beam or an electron beam (a laser beam is employed in the present embodiment). As a result, noble metal material contained in the noble metal tip 32 and the Ni alloy in the ground electrode 27 are fused, and a molten bond 34 is formed. The ground electrode 27 and the noble metal tip 32 are joined together by way of the molten bond 34. In the present embodiment, the protruding length of the noble metal tip 32 in the direction of the X axis is set to 0.3 mm or more.

Prior to the laser welding, a base end portion of the noble metal tip 32 may also be partially embedded in the ground electrode 27 by resistance welding and the like. Further, the noble metal tip 31 provided on the center electrode 5 may be omitted. In this case, the spark discharge gap 33 is defined between the noble metal tip 32 and the leading end portion of the center electrode 5.

Figure 3:
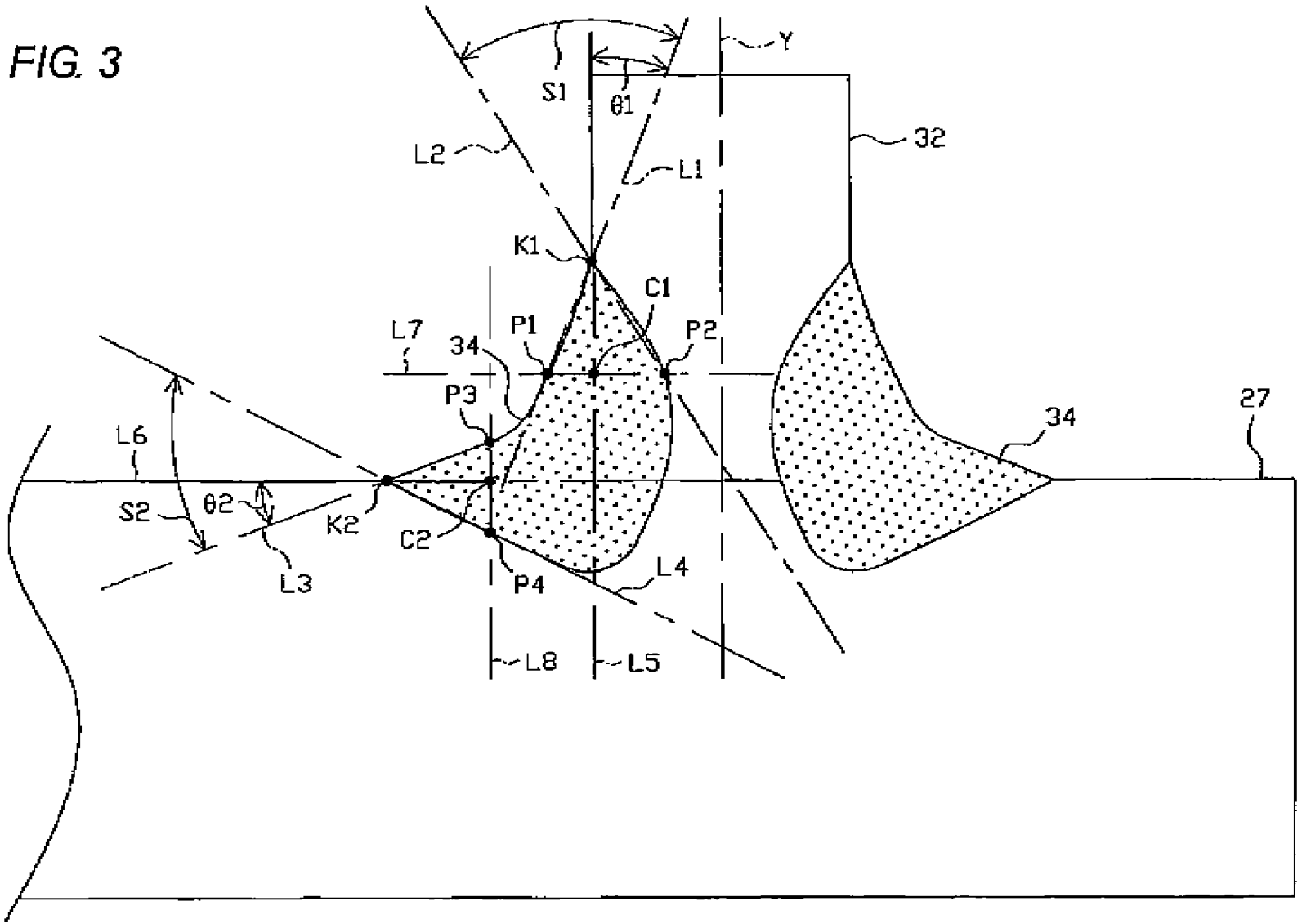
FIG. 3 is a schematic diagram of a noble metal tip, a molten bond and a ground electrode illustrating boundary points, points of intersection, straight lines and imaginary lines defining S1.

As shown in FIG. 3, in a cross section along a longitudinal direction of the ground electrode 27 and that includes a center axis Y of the noble metal tip 32, a first boundary point K1 is defined as a boundary point on a outer surface between the molten bond 34 and the noble metal tip 32; a first imaginary line L7 is defined as a straight line that passes through a middle point C1 between an extension L6 of a visible outline of the ground electrode 27 and the first boundary point K1 in the direction of a center axis Y and that is perpendicular to the center axis Y; a first intersection point P1 is defined as a point of intersection between the first imaginary line L7 and a visible outline of the molten bond 34; a second intersection point P2 is defined as a point of intersection between the first imaginary line L7 and a boundary line between the molten bond 34 and the noble metal tip 32; a first line L1 is defined as a straight line passing through the first boundary point K1 and the first intersection point P1; and a second line L2 is defined as a straight line passing through the first boundary point K1 and the second intersection point P2.

Figure 4:
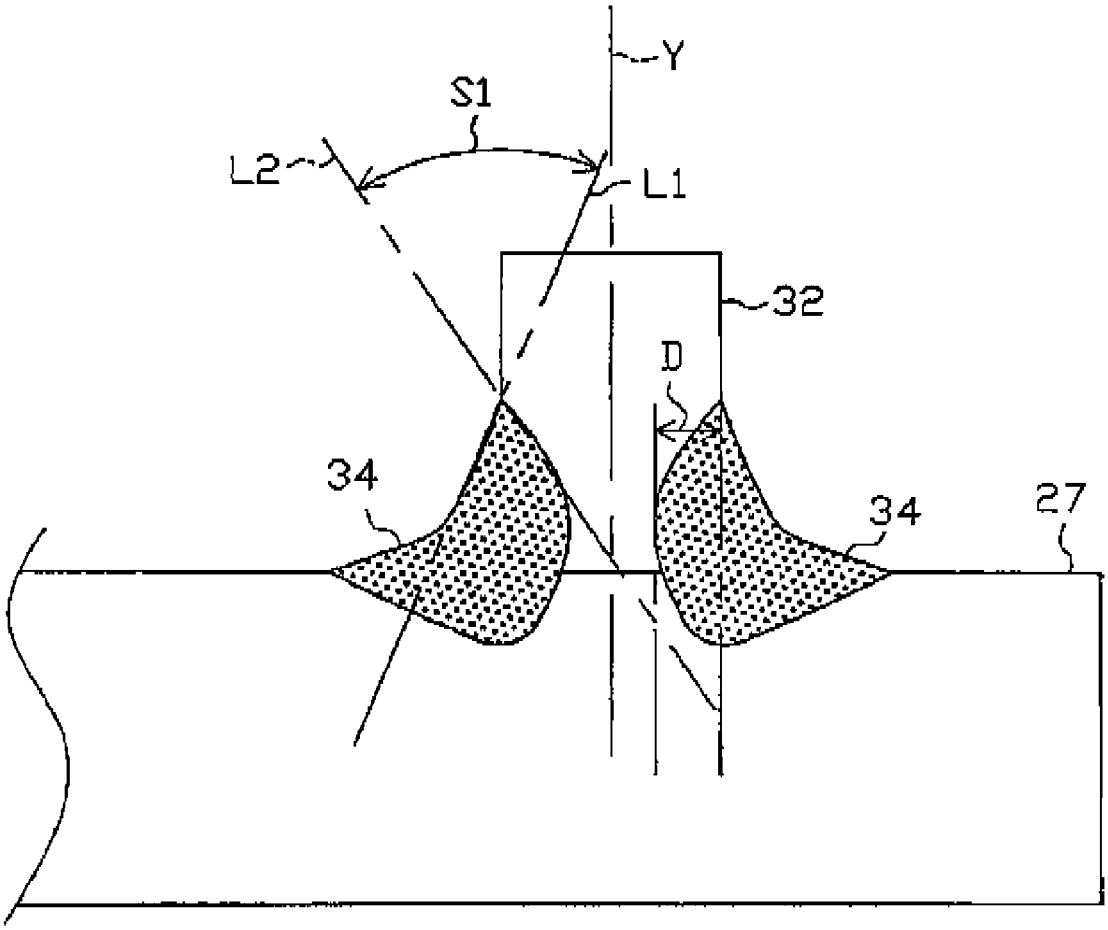
FIG. 4 is a schematic diagram of a noble metal tip, a molten bond and a ground electrode illustrating S1.

In this case, a first molten angle S1(°) is defined as an angle between the first line L1 and the second line L2 (see FIG. 4).

Further, a second boundary point K2 is defined as a boundary point on an outer surface between the molten bond 34 and the ground electrode 27; a second imaginary line L8 is defined as a straight line that passes through a middle point C2 between an extension L5 of a visible outline of the noble metal tip 32 and the second boundary point K2 in a direction orthogonal to the center axis Y and that is parallel to the center axis Y; a third intersection point P3 is defined as a point of intersection between the second imaginary line L8 and a visible outline of the molten bond 34; a fourth intersection point P4 is defined as a point of intersection between the second imaginary line L8 and a boundary line between the molten bond 34 and the ground electrode 27; a third line L3 is defined as a straight line passing through the second boundary point K2 and the third intersection point P3; and a fourth line L4 is defined as a straight line passing through the second boundary point K2 and the fourth intersection point P4.

Figure 5:
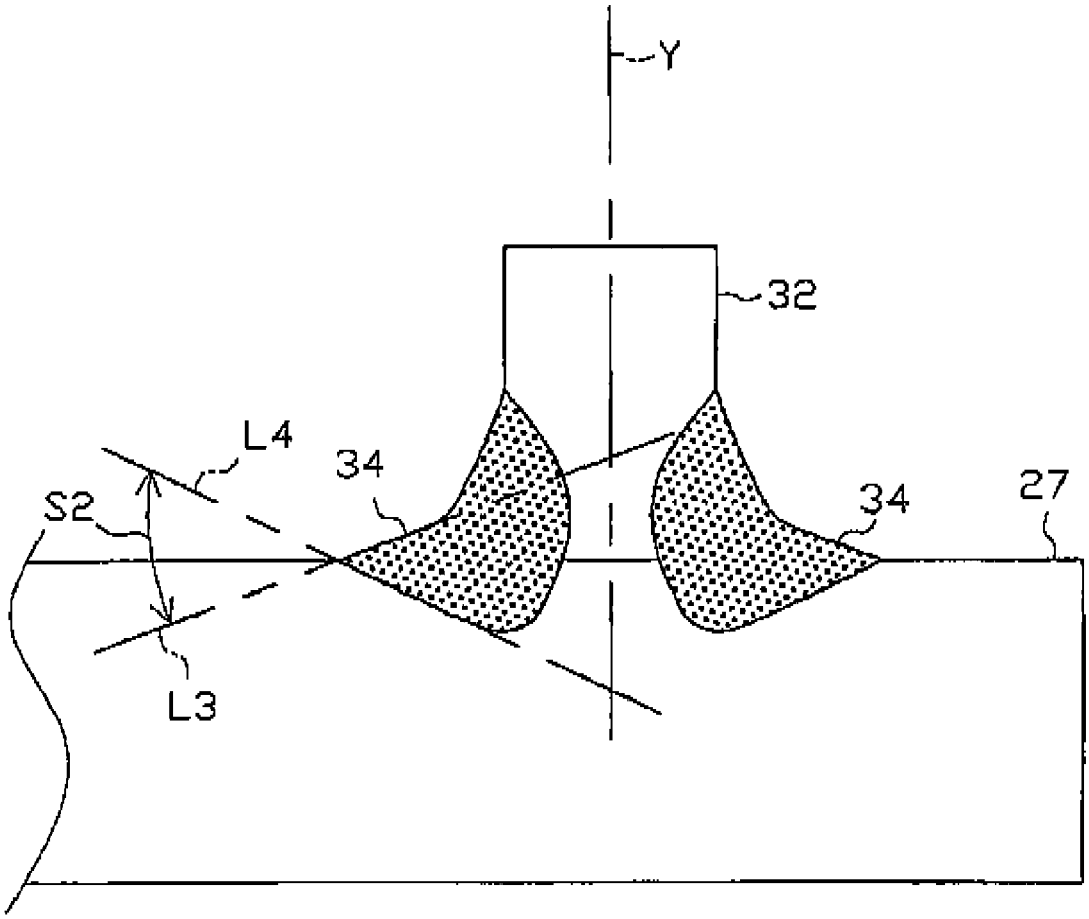
FIG. 5 is a schematic diagram of a noble metal tip, a molten bond and a ground electrode illustrating S2.

In this case, a second molten angle S2(°) is defined as an angle between the third line L3 the fourth line L4 (see FIG. 5).

Figure 6:
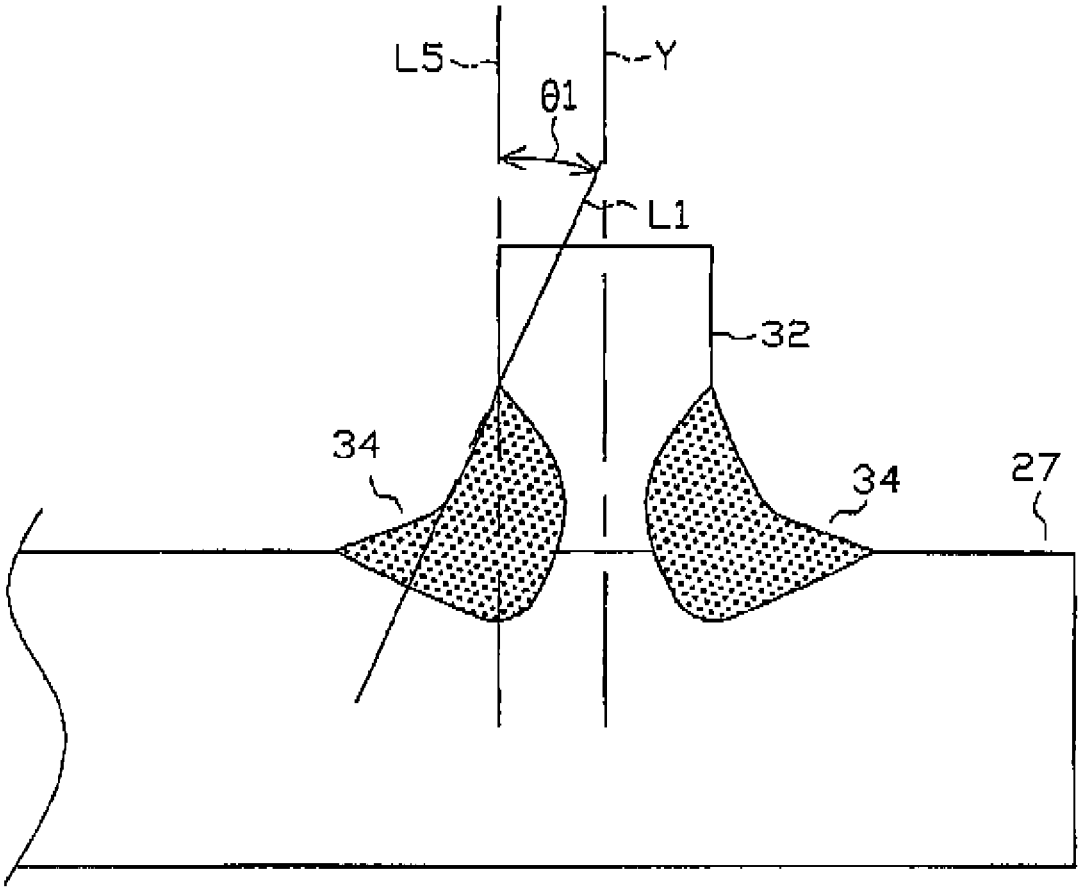
FIG. 6 is a schematic diagram of a noble metal tip, a molten bond and a ground electrode illustrating θ1.
Figure 7:
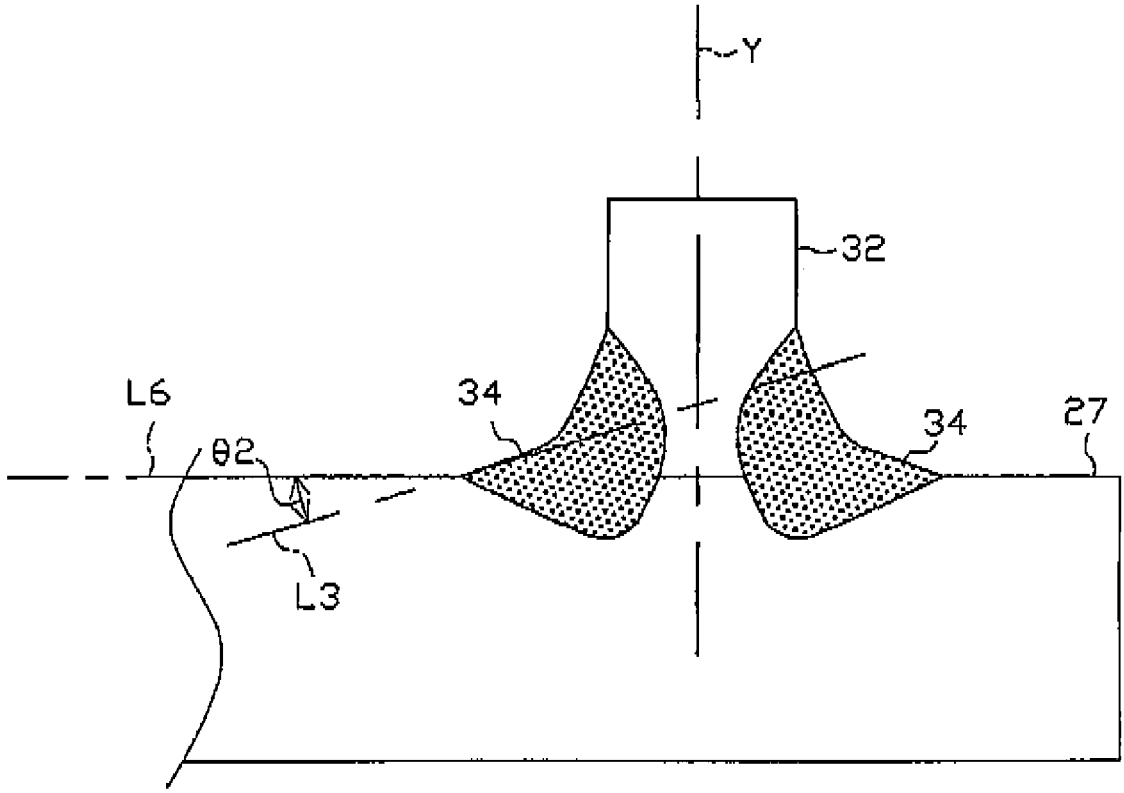
FIG. 7 is a schematic diagram of a noble metal tip, a molten bond and a ground electrode illustrating θ2.

Further, a first contact angle θ1(°) is defined as an angle between the first line L1 and the extension L5 of the visible outline of the noble metal tip 32 (see FIG. 6). A second contact angle θ2(°) is defined as an angle between the third line L3 the extension L6 of the visible outline of the ground electrode 27 (see FIG. 7). In this embodiment, laser welding is carried out so as to satisfy a relationship $50 \leqq S1+S2 \leqq 120$ and a relationship $\theta 1 > \theta 2$.

In FIGS. 3 to 7, the first molten angle S1, the second molten angle S2, the first contact angle θ1 and the second contact angle θ2 are illustrated as vertically opposite angles of intended respective angles. In addition, hatching is omitted in FIGS. 3 to 8 to prevent complication of the drawings, and a dot pattern is provided for the molten bond 34.

In his embodiment, a relationship $1.1 < \theta 1/\theta 2 \leqq 2.0$ is satisfied. Further, a relationship $20 \leqq S2 < S1 \leqq 70$ is also satisfied.

When the cross section along the longitudinal direction of the ground electrode 27 and containing the center axis Y of the noble metal tip 32 is viewed, two molten bonds 34 are present on opposing sides of the noble metal tip 32 in the lateral direction. So long as the molten bonds 34 are symmetrically disposed and have the same size as shown in FIGS. 3 to 7, S1, S2, θ1, and θ2 may be determined based on either of the molten bonds 34. When the molten bonds 34 are asymmetrically disposed or do not have the same size, the angles S1, S2, θ1 and θ2 may be determined by: measuring the first molten angle, the second molten angle, the first contact angle and the second contact angle of each of the molten bonds; and averaging measured respective angles of the molten bonds.

A method for manufacturing the spark plug 1 of this embodiment will be described. First, the metal shell 3 is processed in advance. Specifically, a through hole is formed in a cylindrical metal material (an iron-based material or a stainless steel material such as S17C or S25C) by cold forging, to thereby form a rough shape of the metal shell 3. Subsequently, the material is subjected to cutting process, to thereby shape the contour of the material, thus obtaining a metal shell intermediate body.

The ground electrode 27 containing a Ni alloy such as Inconel (trade name)-based alloy is attached to the leading end surface of the metal shell intermediate body by resistance welding. Since so-called "sag" is generated during the welding, the threaded portion 15 is formed at a predetermined location on the metal shell intermediate body by rolling after removing the sag. Accordingly, the metal shell 3 welded to the ground electrode 27 is obtained. After the noble metal tip 32 joined to the ground electrode 27, the ground electrode 27 may be welded to the metal shell intermediate body. The metal shell 3 welded to the ground electrode 27 is subjected to zinc plating or nickel plating. In order to enhance corrosion resistance, the surface of the metal shell may be subjected to chromate treatment.

Further, the noble metal tip 32 is joined to the distal end portion of the ground electrode 27. More specifically, the noble metal tip 32 is disposed on (or temporarily attached to) a predetermined portion of the ground electrode 27. The outer edge of the interface between the ground electrode 27 and the noble metal tip 32 is intermittently exposed to a laser beam while the noble metal tip 32 is rotated, relative to laser radiation means, around the center axis Y of the noble metal tip 32 as an axis of rotation. As a result, a plurality of molten spots (molten bonds 34) are formed to have a continuous annular pattern when viewed from the distal end surface of the noble metal tip 32. Consequently, the ground electrode 27 and the noble metal tip 32 are joined together. The laser beam radiation is performed while adjusting a radiation angle, a radiation point radiation energy and a pulse width of a laser beam such that the angles S1, S2, $\theta_1$ and $\theta_2$ satisfy the relationships described above.

In order to perform the welding more reliably, plating is removed from the welded region prior to the welding, or the region to be welded is masked during the plating process. The noble metal tip 32 may be welded after an attaching operation described below.

The insulator 2 is previously molded separately from the metal shell 3. For example, a base granulation material for molding is prepared using a raw powder containing alumina as a main component and a binder. The granulation material is subjected to rubber press molding to obtain a cylindrical molded element. The mold thus obtained is subjected to cutting to shape the same. The shaped material is placed into a furnace and sintered, whereby the insulator 2 is obtained.

The center electrode 5 is manufactured separately from the metal shell 3 and the insulator 2. Specifically, an Ni alloy is forged, and an inner layer 5A containing a copper alloy is provided in the center of the forged alloy in order to enhance heat radiation. The noble metal tip 31 is joined to a leading end portion of the center electrode by welding such as resistance welding, laser welding, or the like.

The insulator 2 and the center electrode 5 thus obtained, the resistor 7 and the terminal electrode 6 are fixedly sealed by glass seal layers 8 and 9. As the glass seal layers 8 and 9, borosilicate glass and metal powder are usually mixed and prepared. After the glass seal layers are inserted into the axis hole 4 of the insulator 2 such that the resistor 7 is sandwiched between the glass seal layers, the terminal electrode 6 is pressed from the base end side. In this state, the assembly is sintered in the furnace. At this time, a glaze layer on the surface of the base end barrel portion 10 of the insulator 2 may also be sintered simultaneously, or a glaze layer may be formed in advance.

Subsequently, the insulator 2 having the center electrode 5 and the terminal electrode 6, which have been manufactured as described above, are attached to the metal shell 3 having the ground electrode 27. More specifically, the insulator 2 and the metal shell 3 are fixed by crimping the crimping portion 20 in a radially inward direction, which crimping portion is formed as a comparatively thin extension of the base end of the metal shell 3.

Finally, the ground electrode 27 is bent, and processed for adjusting the spark discharge gap 33 between the noble metal tip 31 provided at the leading end of the center electrode 5) and the noble metal tip 32 (provided on the ground electrode 27).

The spark plug 1 structured as above is produced by following these series of steps.

The following test was conducted in order to confirm the advantages of this embodiment. Specifically, a columnar-shaped alloy containing platinum as a main component and rhodium (Pt-20Rh at %) and having a diameter of 0.7 mm and a height of 0.8 mm was prepared as a sample of the noble metal tip 32. Further, INCONEL 601 (trade name) was prepared as a sample of the ground electrode 27 (a nickel-based alloy). Laser welding was performed while the radiation angle, radiation point, radiation energy and pulse width of the laser beam were appropriately adjusted such that the angles S1, S2, θ1 and θ2 assumed predetermined values, to thus manufacture evaluation samples. The fused depth of the molten bond (corresponding to symbol D in FIG. 4) was adjusted to 0.25 mm in the respective evaluation samples.

The respective evaluation samples were subjected to a "burner thermal test," a "first thermal durability test in actual use," and a "second thermal durability test in actual use." More specifically, in relation to the "burner thermal test," a burner was set such that the temperature of the noble metal tip reached 1100° C. when the tip was heated. In this state, the rod-shaped evaluation samples were subjected to 1000 cycles in which each of the samples was heated for two minutes and slowly cooled for one minute. A grade of "○" (circle) was assigned when no cracking occurred at all; a grade of "Δ" (triangle) was assigned when slight cracking which did not greatly affect exfoliation of the noble metal tip occurred; and a grade of "x" (cross mark) was assigned when cracking to a great extent or exfoliation of the noble metal tip occurred.

The "first thermal durability test in actual use" and the "second thermal durability test in actual use" are conducted under conditions harsher than those for the "burner thermal test" and are performed after manufacture of spark plug samples using the evaluation samples. Specifically, in the "first thermal durability test in actual use," spark plug samples were attached to a six-cylinder in-line engine having a piston displacement of 2000 cc, and its full-throttle engine speed was set to 5000 rpm (the temperature of the ground electrode was set to about 1000° C. at this time). In this setting, the samples were subjected to 1000 cycles, in each cycle of which the engine was ran at full throttle for one minute and subsequently run at an idle rotational speed (of about 700 rpm) for one minute. The samples thus subjected to cycle testing were evaluated as described above. In addition, the samples were inspected to determine whether serious imperfections, such as scooping, were present.

The "second thermal durability test in actual use" is performed under conditions harsher than those for the "first thermal durability test in actual use." Specifically, in the "second thermal durability test in actual use," spark plug samples were attached to a four-cylinder in-line engine having a piston displacement of 2000 cc, and the full-throttle engine speed was set to 6500 rpm (the temperature of the ground electrode was set to about 1050° C. at this time). In his setting, the samples were subjected to 1000 cycles, in each cycle of which the engine was run at full throttle for one minute and subsequently stalled for one minute. The samples thus subjected to cycle testing were evaluated as described above. In addition, the samples were inspected to determine whether serious imperfections were present. In relation to the respective tests, those samples evaluated "x" in the "burner thermal test" were in principle not subjected to the "first thermal durability test in actual use." Those samples evaluated "x" in the "first thermal durability test in actual use" or those samples ascertained to have serious imperfections were in principle not subjected to the "second thermal durability test in actual use" (there were several exceptions).

The results of the respective tests are given in Table 1.

TABLE 1

| SAMPLE | CONTACT ANGLE | | | MOLTEN ANGLE | | | TEST RESULTS | | |
|---|---|---|---|---|---|---|---|---|---|
| | | | | | | | BURNER | FIRST THERMAL | FIRST THERMAL |
| No. | θ1 | θ2 | θ1/θ2 | S1 | S2 | S1 + S2 | THERMAL TEST | DURABILITY TEST | DURABILITY TEST |
| 1 | 21 | 15 | 1.40 | 40 | 36 | 76 | ○ | ○ | ○ |
| 2 | 15 | 12 | 1.25 | 26 | 20 | 46 | x | x (TIP LOSS) | — |
| 3 | 18 | 13 | 1.38 | 28 | 22 | 50 | ○ | ○ | ○ |
| 4 | 30 | 15 | 2.00 | 45 | 30 | 75 | ○ | ○ | ○ |
| 5 | 33 | 14 | 2.36 | 45 | 30 | 75 | ○ | Δ | — |
| 6 | 8 | 5 | 1.60 | 22 | 16 | 38 | x | — | — |
| 7 | 20 | 18 | 1.11 | 35 | 37 | 72 | ○ | ○ | Δ |
| 8 | 35 | 27 | 1.30 | 77 | 43 | 120 | ○ | ○ | Δ |
| 9 | 44 | 28 | 1.57 | 73 | 69 | 142 | Δ | (SCOOPING) | — |
| 10 | 18 | 17 | 1.06 | 32 | 30 | 62 | ○ | Δ | — |
| 11 | 22 | 16 | 1.38 | 34 | 18 | 52 | ○ | ○ | Δ |
| 12 | 13 | 16 | 0.81 | 30 | 29 | 59 | x | — | — |
| 13 | 17 | 17 | 1.00 | 31 | 30 | 61 | x | — | — |
| 14 | 17 | 22 | 0.77 | 32 | 35 | 67 | x | — | — |

Table 1 shows that samples 1, 3 and 4, all of which satisfy the relationships $50 \leqq S1+S2 \leqq 120$, $\theta 1 > \theta 2$, $1.1 < \theta 1/\theta 2 \leqq 2.0$ and $20 \leqq S2 < S1 \leqq 70$, did not exhibit cracking and provided superior exfoliation resistance in all of the "burner thermal test," the "first thermal durability test in actual use," and the "second thermal durability test in actual use."

In contrast, in Sample No. 2 having S1+S2 less than 50 (S+S2=46), large cracking occurred in the "burner thermal test" whose test conditions are the least severe among the three tests, and loss of the noble metal tip occurred in the "first thermal durability test in actual use." Further, in Sample No. 6 (S1+S2=38 and S2=16), large cracking and loss of the noble metal tip occurred in the "burner thermal test."

The above results shows that when S1+S2 is less than 50, the volume of the molten bonds is not. An oxidation scale is thus formed as a result of repetition of a cold-hot cycle, to thereby induce loss of the noble metal tip, and the like.

Conversely, in Sample No. 9 having S1+S2 exceeding 120 (=142), cracking occurred to a small extent in the "burner thermal test," and scooping of the molten bond occurred in the "first thermal durability test in actual use." The molten bond is considered to be scooped by corrosion since the molten bond is excessively large.

Further, in Sample Nos. 12, 13 and 14 satisfying a relationship $\theta 1 \leqq \theta 2$, large cracks occurred in the "burner thermal test." This result is considered to have been induced by deteriorated corrosion resistance due to an insufficient amount of the noble metal tip fused in the molten bond.

Next, samples satisfying the relationships $50 \leqq S1+S2 \leqq 120$ and $\theta 1 > \theta 2$ will be explained. Those samples satisfying the relationship $50 \leqq S1+S2 \leqq 120$ and $\theta 1 > \theta 2$ were graded "○" in the "burner thermal test." Accordingly, the exfoliation resistance can be enhanced when at least the above relationships are satisfied. However, even when satisfied, in Sample No. 5($\theta 1/\theta 2=2.36$) whose value of $\theta 1/\theta 2$ exceeds 2.0, cracking to a small extent occurred in the "first thermal durability test in actual use." Conversely, in Sample No. 10 whose value of $1/\theta 2$ is below 1.1, cracking to a small extent also occurred in the "first thermal durability test in actual use." In the former case (Sample No. 5), the amount of the noble metal tip fused in the molten bond is considered to have been excessively large. Therefore, strain between the ground electrode and the molten bond due to the stress easily occurs, and cracking occurs at the interface between the ground electrode and the molten bond. In the latter case (Sample No. 10), a slight deficiency in the amount of the noble metal tip fused in the molten bond is considered to be a cause.

In Sample Nos. 7, 8 and 11 not satisfying a relationship $20 \leqq S2 < S1 \leqq 70$ (in Sample No. 7 where $S2>S1$; in Sample No. 8 where $S1>70$; and in Sample No. 11 where $S2<20$), cracking did not occur in the "first thermal durability test in actual use," but cracking to a small extent occurred in the "second thermal durability test in actual use." In these cases, the spark plugs do not raise any problem in actual use. However, a volume balance between the part of the noble metal tip in the molten bond and the part of the ground electrode in the molten bond is considered to be slightly deteriorated, such that cracking to a small extent occurs in the "second thermal durability test in actual use" as a consequence.

Although the above description was given according to an embodiment of the present invention, the present invention is not limited thereto. It is a matter of course that various modes of carrying out the principles disclosed herein may be adopted without departing from the spirit and scope of the claims appended hereto. For example, the present invention may be embodied as follows.

Figure 8:
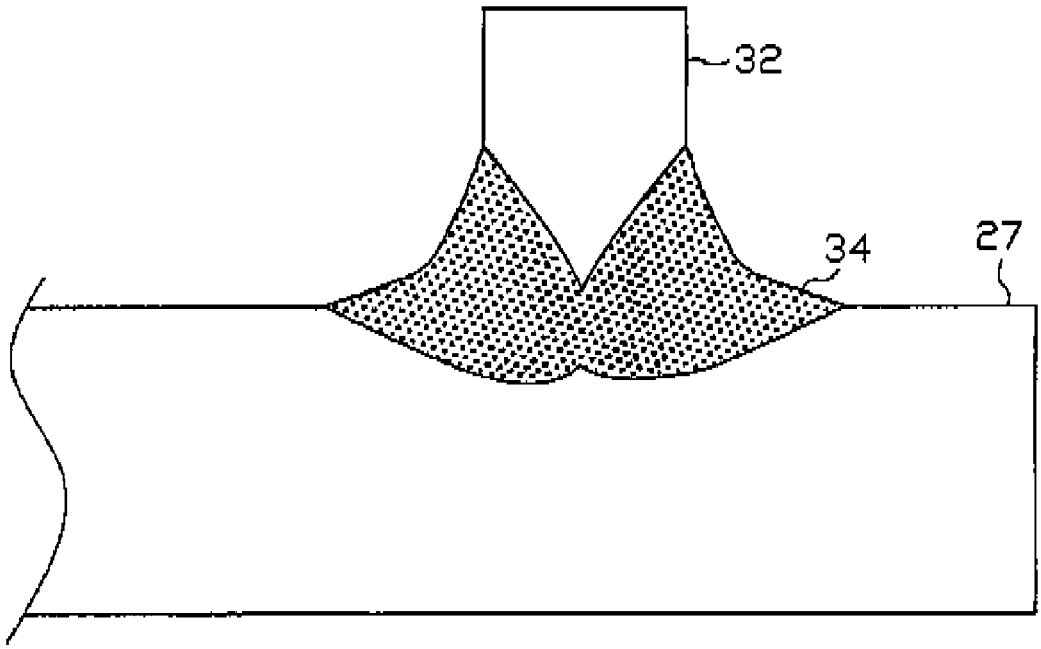
FIG. 8 is a schematic diagram of a modified example of a molten bond.

(a) In the above embodiment, the molten bond 34 is formed so as not to exceed the center axis Y of the noble metal tip 32. However, at least one of the right and left portions of the molten bond 34 in the cross section may exceed the center axis Y. Further, as shown in FIG. 8, left and right portions of the molten bond 34 in the cross sectional view may be connected.

(b) In the above embodiment, each of the molten bonds 34 is configured as described above. One molten bond located at the distal end side of the ground electrode 27 tends to reach a higher temperature than another molten bond located at the base end side of the ground electrode 27. Therefore, at least the one molten bond (located at the base end side of the ground electrode 27) of the molten bonds preferably has the configuration of the above described embodiment.

(c) Although the ground electrode 27 contains an Ni alloy in this embodiment, the ground electrode 27 may have a two-layer structure including an inner layer and an outer layer. In his case, preferably, at least the outer layer contains an Ni alloy.

(d) The material contained in the noble metal tips 31 and 32 is not limited. For example, in addition to the Pt-Ir alloy and the Pt-Rh alloy illustrated in the embodiment, a noble metal containing iridium as a main component may be used for the noble metal tips 31 and 32.

(e) Although not particularly described in the above embodiment, an electrode having a relatively small distal end area (e.g., ranged from 2.0 $mm^2$ to 3.5 $mm^2$) may be used as the ground electrode 27 in light of recent demands for miniaturization of the spark plug. Thus, when the cross sectional area is comparatively small, the heat dissipation property of the ground electrode 27 is deteriorated. Therefore, the temperature of the ground electrode 27 is likely to become elevated, and a balance in thermal stress imposed on the noble metal tip 32 is more easily lost. In this regard, the unbalance of thermal stress can be stably prevented by adopting the structure of the embodiment. Specifically, under conditions where the temperature of the ground electrode 27 becomes elevated, the advantages attained by the structure of the embodiment become more apparent.

(f) In the above embodiment, the ground electrode 27 is joined to the leading end of the metal shell 3. However, the ground electrode may be formed by cutting a portion of the metal shell (or by cutting a portion of leading end metal fitting previously welded to the metal shell), as described, for example, in JP-A-2006-236906 incorporated herein by reference.

(g) In the embodiment, the tool engagement portion 19 has hexagonal cross section, but the shape of the tool engagement portion 19 is not limited thereto. For example, the tool engagement portion may have, for example, a Bi-HEX (deformed dodecagon) shape (ISO22977: 2005 (e)).

This application is based on Japanese Patent Application No. 2007-309620 filed Nov. 30, 2007, the above application incorporated herein by reference in its entirety.

What is claimed is:

1. A spark plug for an internal combustion engine, comprising:

a cylindrical insulator having an axial hole extending in an axial direction;

a center electrode inserted in the axial hole and extending from a base end thereof to a leading end thereof in the axial direction;

a cylindrical metal shell provided on an outer periphery of the insulator and extending from a leading end thereof to a base end thereof in the axial direction;

a ground electrode extending from base end thereof provided on a leading end portion of the metal shell to a distal end thereof; and a noble metal tip containing a noble metal as a main component and having a base end joined to a side surface of a distal end portion of the ground electrode and a distal end surface facing a leading end portion of the center electrode, wherein a protruding length of the noble metal tip from the side surface of the distal end portion of the ground electrode in a direction along a center axis of the noble metal tip is 0.3 mm or more, wherein the noble metal tip is joined to the ground electrode by a molten bond in which the noble metal tip and the ground electrode are fused; and, wherein relationships (i) and (ii) are satisfied for a first molten angle S1, a second molten angle S2, a first contact angle $\theta 1$ and a second contact angle $\theta 2$:

$$50 \leqq S1+S2 \leqq 120; \text{ and} \quad \text{(i)}$$

$$\theta 1 > \theta 2, \quad \text{(ii)}$$

where, in a cross section along a longitudinal direction of the ground electrode and containing the center axis of the noble metal tip, a first boundary point is defined as a boundary point on an outer surface between the molten bond and the noble metal tip;

a first imaginary line is defined as a straight line that is perpendicular to the center axis of the noble metal tip and that passes through a middle point between an extension of a visible outline of the ground electrode and the first boundary point in the direction along the center axis of the noble metal tip;

a first intersection point is defined as a point of intersection between the first imaginary line and a visible outline of the molten bond;

a second intersection point is defined as a point of intersection between the first imaginary line and a boundary line between the molten bond and the noble metal tip;

a first line is defined as a straight line passing through the first boundary point and the first intersection point;

a second line is defined as a straight line passing through the first boundary point and the second intersection point;

the first molten angle S1 [°] is defined as an angle between the first line and the second line;

a second boundary point is defined as a boundary point between the outer surface of the molten bond and an outer surface of the ground electrode;

a second imaginary line is defined as a straight line that is parallel to the center axis of the noble metal tip and that passes through a middle point between an extension of a visible outline of the noble metal tip and the second boundary point in a direction orthogonal to the center axis of the noble metal tip;

a third intersection point is defined as a point of intersection between the second imaginary line and the visible outline of the molten bond;

a fourth intersection point is defined as a point of intersection between the second imaginary line and a boundary line between the molten bond and the ground electrode;

a third line is defined as a straight line passing through the second boundary point and the third intersection point;

a fourth line is defined as a straight line passing through the second boundary point and the fourth intersection point;

the second molten angle S2 [°] is defined as an angle between the third line and the fourth line;

the first contact angle θ1 [°] is defined as an angle between the first line and the extension of the visible outline of the noble metal tip; and the second contact angle θ2 [°] is defined as an angle between the third line and the extension of the visible outline of the ground electrode.

2. The spark plug according to claim 1, wherein a relationship $1.1<\theta 1/\theta 2<2.0$ is satisfied.

3. The spark plug according to claim 1, wherein a relationship $20\leqq S2<S1\leqq 70$ is satisfied.

* * * * *